US008405328B2

(12) United States Patent
Komiyama et al.

(10) Patent No.: US 8,405,328 B2
(45) Date of Patent: Mar. 26, 2013

(54) SLEWING CONTROL DEVICE AND WORKING MACHINE INCORPORATED WITH THE SAME

(75) Inventors: Masayuki Komiyama, Hiroshima (JP); Natsuki Yumoto, Hiroshima (JP); Yoshiyasu Umezu, Hiroshima (JP); Masayuki Kogashima, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 235 days.

(21) Appl. No.: 13/036,391

(22) Filed: Feb. 28, 2011

(65) Prior Publication Data

US 2011/0227512 A1 Sep. 22, 2011

(30) Foreign Application Priority Data

Mar. 17, 2010 (JP) ..... 2010-060172

(51) Int. Cl.
*H02P 3/04* (2006.01)

(52) U.S. Cl. ..... 318/369; 318/362; 318/371; 318/372; 60/327; 60/466; 212/276; 212/284

(58) Field of Classification Search ..... 318/362, 318/369, 371, 372, 375, 363; 60/327, 466; 212/276, 284; 701/50
See application file for complete search history.

(56) References Cited

U.S. PATENT DOCUMENTS 5,062,266 A * 11/1991 Yoshimatsu ..... 60/466
5,159,813 A * 11/1992 Yoshimatsu et al. ..... 60/459
5,272,877 A * 12/1993 Fukushima et al. ..... 60/327
7,659,677 B2 * 2/2010 Yoshimatsu et al. ..... 318/371
7,831,333 B2 * 11/2010 Sawodny et al. ..... 700/213
7,869,923 B2 * 1/2011 Kawaguchi ..... 701/50
2002/0060589 A1 * 5/2002 Ziemer ..... 327/108
2006/0265120 A1 * 11/2006 Coleman et al. ..... 701/209
2007/0057842 A1 * 3/2007 Coleman et al. ..... 342/359
2007/0186451 A1 * 8/2007 Yoshimatsu ..... 37/348
2007/0219662 A1 * 9/2007 Sawodny et al. ..... 700/213
2008/0065298 A1 * 3/2008 Kawaguchi ..... 701/50
2010/0236232 A1 * 9/2010 Boehm et al. ..... 60/413
2010/0263364 A1 * 10/2010 Tsutsui et al. ..... 60/466
2010/0264106 A1 * 10/2010 Kawai et al. ..... 212/276
2012/0305513 A1 * 12/2012 Muller et al. ..... 212/284

FOREIGN PATENT DOCUMENTS

JP 2005-299102 10/2005
JP 2007-239454 9/2007

* cited by examiner

*Primary Examiner* — Paul Ip
(74) *Attorney, Agent, or Firm* — Oblon, Spivak, McClelland, Maier & Neustadt, L.L.P.

(57) ABSTRACT

There is provided a slewing control device that enables to detect breakdown of a driving system of a mechanical brake, and generate a torque for holding a slewing body in a stopped state to thereby prevent movement of the slewing body when an anomaly has occurred. In a working machine for driving a slewing body by an electric motor 1, judgment is made as to whether a mechanical brake 4 is in an inconsistent state, based on a command to be outputted to a brake circuit B, and a pressure detected by a brake pressure sensor 17. The inconsistent state is a state that the mechanical brake 4 is in a brake released state when an activation command for switching the mechanical brake 4 to a brake activated state is outputted. If it is judged that the mechanical brake 4 is in the inconsistent state, a command for obtaining a braking torque for holding the slewing body in a stopped state is outputted to the electric motor 1.

8 Claims, 4 Drawing Sheets

SLEWING CONTROL DEVICE AND WORKING MACHINE INCORPORATED WITH THE SAME

BACKGROUND OF THE INVENTION

1. Field of the Invention

The present invention relates to a slewing control device for an electric-motor-driven working machine for driving and slewing a slewing body by an electric motor.

2. Description of the Background Art

There is known an electric-motor-driven working machine (e.g. a shovel) using an electric motor as a drive source for driving a slewing body.

Further, in the electric-motor-driven working machine, there is also known a technology of activating a mechanical brake to hold the slewing body in a stopped state (see Japanese Unexamined Patent Publication No. 2007-239454).

FIG. 4 shows an arrangement of a conventional electric-motor-driven slewing control device incorporated with a mechanical brake.

The device shown in FIG. 4 is provided with an electric motor 1 for driving and slewing a slewing body, a slewing inverter 2 for controlling the electric motor 1, a battery 3 to be connected to the electric motor 1 via the slewing inverter 2, a hydraulic mechanical brake 4 for generating a mechanical braking force for the electric motor 1, a brake circuit B for driving the mechanical brake 4, a clockwise-slewing remote control valve 7*r* and a counterclockwise-slewing remote control valve 7*l* which are adapted to generate a secondary pressure depending on operation amounts of levers, pressure sensors 8, 8 for detecting the presence or absence of lever operation and operation amounts of the remote control valves 7*r*, 7*l*, respectively, and a slewing controller 9 for controlling the electric motor 1 and the brake circuit B.

The electric motor 1 is driven by an electric power from the battery 3. In a hybrid machine, a power generator or a generator motor to be driven by an engine may also serve as a drive source for the electric motor 1.

The mechanical brake 4 is a negative brake which generates a braking force by a spring force in a state that a hydraulic pressure is not applied. A slewing operation (acceleration or deceleration) of the slewing body is performed in a state that the mechanical brake 4 is released.

The brake circuit B includes a hydraulic pump 5 to be driven by an unillustrated engine, and an electromagnetically switchable brake valve 6 which is operable to be switched between a discharge position P1 and a supply position P2. When the brake valve 6 is switched to the discharge position P1, hydraulic oil is discharged from the mechanical brake 4 to a tank T to thereby switch the mechanical brake 4 to a brake activated state. On the other hand, when the brake valve 6 is switched to the supply position P2, hydraulic oil is fed from the hydraulic pump to the mechanical brake 4 to thereby switch the mechanical brake 4 to a brake released state.

The brake valve 6 has a solenoid 6*a* for driving the brake valve 6.

The pressure sensor 8, 8 is adapted to convert the presence or absence of lever operation and an operation amount of the remote control valve 7*r*, 7*l* into an electrical signal (a slewing operation signal), and is adapted to output the electrical signal to the slewing controller 9.

The slewing controller 9 has a control command generator 10 for receiving the slewing operation signals, and a brake controller 11 for controlling the brake valve 6.

The control command generator 10 outputs, to the slewing inverter 2, a control command for accelerating decelerating, or stopping the electric motor 1 depending on an operation amount (hereinafter, an operation of the remote control valve 7*r*, 7*l* is called as an operation of a lever, and an operation amount of the remote control valve 7*r*, 7*l* is called as an operation amount of a lever) of the remote control valve 7*r*, 7*l*.

The brake controller 11 outputs, to the brake valve 6 (solenoid 6*a*), a brake control command corresponding to a brake release command to be outputted when the lever is operated, or a brake activation command to be outputted when the lever is set to a neutral position (when the lever is not operated).

With the above arrangement, when the lever is operated, the electric motor 1 is accelerated, decelerated, or stopped, based on a torque command depending on an operation amount of the lever in a state that the mechanical brake 4 is switched to a brake released state. On the other hand, when the lever is set to the neutral position, the mechanical brake 4 is switched to a brake activated state, and the electric motor 1 (an upper slewing body) is held in a stopped state.

A speed of the electric motor 1 is detected by an electric motor speed sensor 12, and a value indicative of the detected speed is outputted to the control command generator 10 in the slewing controller 9. In the case where the speed of the electric motor 1 is set to zero, or in the case where a predetermined time (which is counted by an unillustrated timer) has elapsed after the lever is set to the neutral position, it is judged that the electric motor 1 has stopped, and the mechanical brake 4 is switched to a brake activated state.

If an operation anomaly has occurred in the electric-motor driven system having the above arrangement, a braking force may not be generated, even if a brake activation signal is outputted from the slewing controller 9. The operation anomaly of the system includes a phenomenon called "locking" that a spool of the brake valve 6 is locked and unmoved at the supply position P2, clogging of a passage to the brake valve 6, and clogging of a pipeline between the brake valve 6 and the mechanical brake 4.

The conventional art disclosed in Japanese Unexamined Patent Publication No. 2007-239454 is silent about the aforementioned brake-related problem, and it is impossible to cope with the brake-related problem.

Unlike a hydraulic slewing system configured such that a hydraulic retaining force by a valve is applied to a slewing body, in the electric-motor-driven slewing system, a hydraulic retaining force is not applied to a slewing body. Accordingly, in the electric-motor-driven slewing system, the slewing body may freely slew in response to stopping of torque control for the electric motor 1, and it may be difficult or impossible to prevent movement of the slewing by the weight thereof on an inclined ground.

SUMMARY OF THE INVENTION

An object of the invention is to provide a slewing control device for a working machine that enables to detect breakdown of a driving system of a mechanical brake, and generate a retaining torque for stopping a slewing body to thereby prevent movement of a slewing body when an anomaly has occurred.

An aspect of the invention is to provide a slewing control device for a working machine having a slewing body. The slewing control device includes an electric motor which slews the slewing body; an operation member which is operable to output a slewing command including information corresponding to presence or absence of an operation by an operator, and information corresponding to a slewing direction and a slewing amount of the slewing body in response to the operation by the operator; a mechanical brake which is operable to be switched between a brake activated state in which the slewing body is held so that slewing of the slewing body is restricted, and a brake released state in which holding of the slewing body is released; a brake circuit which is adapted to switch the mechanical brake between the brake activated state and the brake released state; a brake activation detecting member which detects whether the mechanical brake is in the brake activated state or in the brake released state; and a controller which controls the electric motor and the brake circuit. In the above arrangement, the controller is operable to output a control command for accelerating, decelerating, or stopping the electric motor, based on the slewing command from the operation member; and is operable to output, to the brake circuit, a release command for switching the mechanical brake to the brake released state when the operation member is operated, and output, to the brake circuit, an activation command for switching the mechanical brake to the brake activated state when the operation member is not operated. The controller judges whether the mechanical brake is in an inconsistent state that is a state that the mechanical brake is in the brake released state when the activation command is outputted, based on a command to be outputted to the brake circuit and the brake activated state detected by the brake activation detecting member, and outputs, to the electric motor, a command for obtaining a braking torque for holding the slewing body in a stopped state, if it is judged that the mechanical brake is in the inconsistent state.

Another aspect of the invention is to provide a working machine which includes the slewing control device having the above arrangement, and a slewing body which is slewed by the electric motor of the slewing control device.

These and other objects, features and advantages of the present invention will become more apparent upon reading the following detailed description along with the accompanying drawings.

DETAILED DESCRIPTION OF THE PREFERRED EMBODIMENTS OF THE INVENTION

Figure 1:
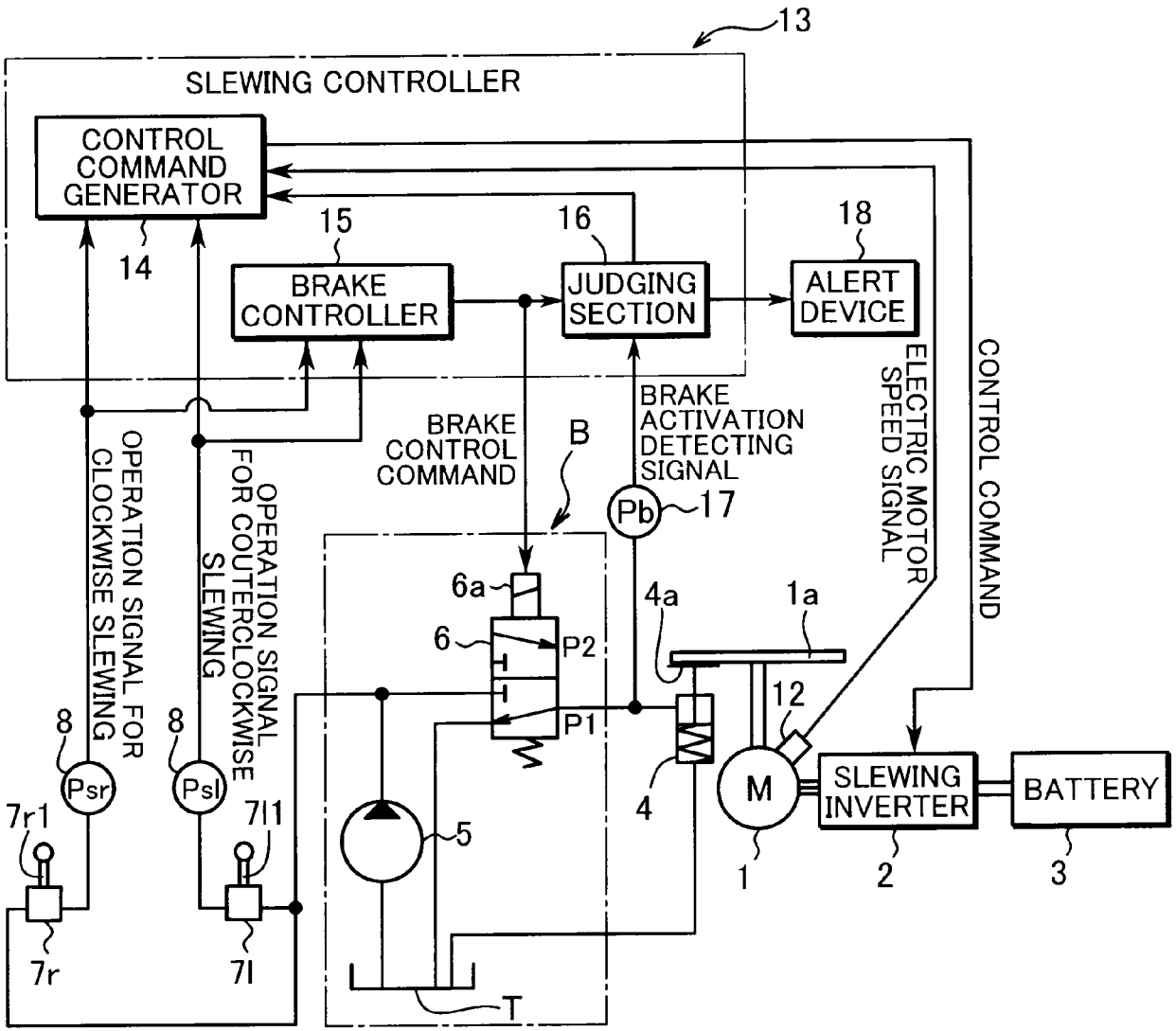
FIG. 1 is a block diagram showing an arrangement of a slewing control device embodying the invention.

In the following, embodiments of the invention are described referring to the drawings. The following embodiments are merely examples embodying the invention, and do not limit the technical scope of the invention.

Figure 2:
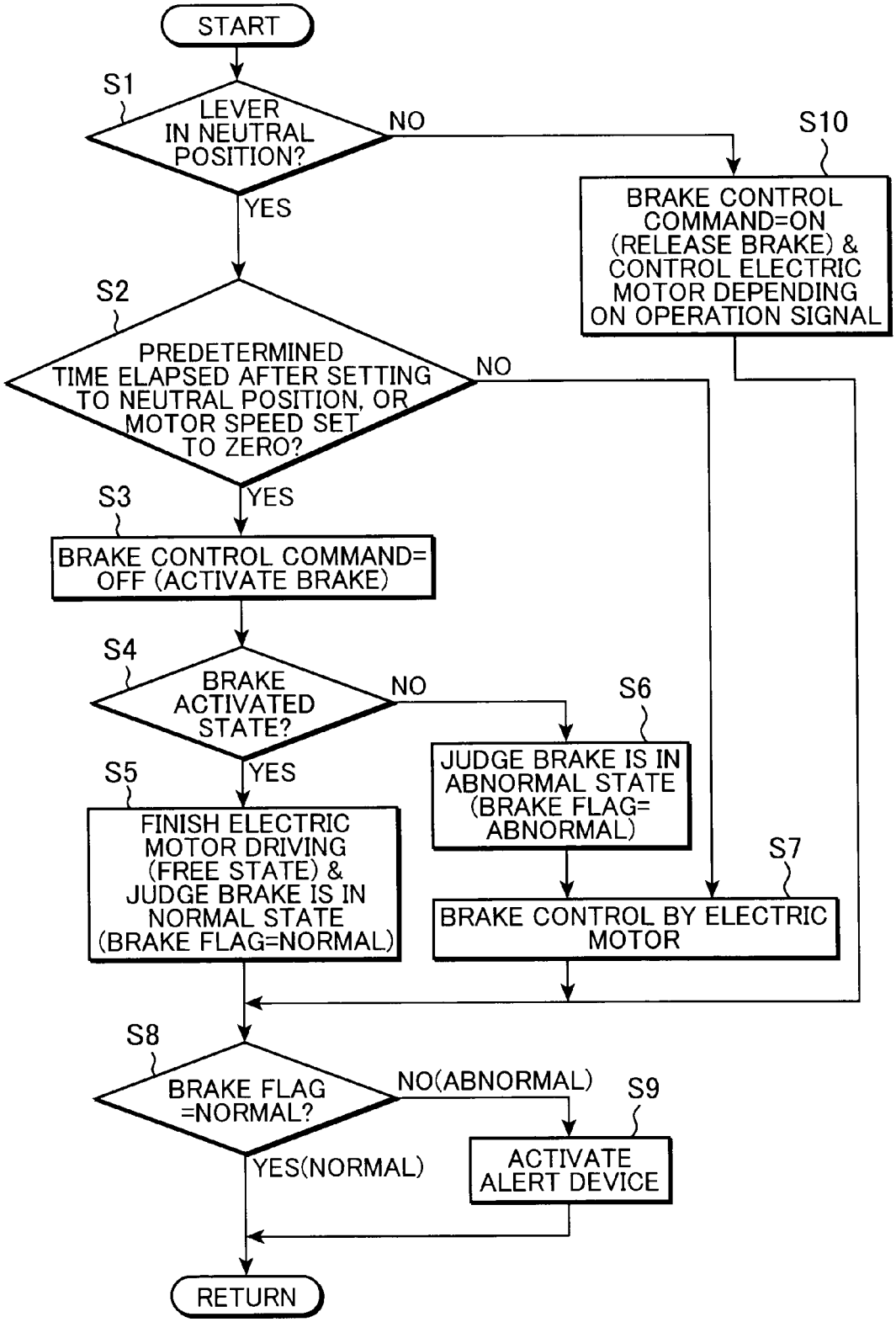
FIG. 2 is a flowchart showing a process to be executed by a slewing controller shown in FIG. 1.
Figure 3:
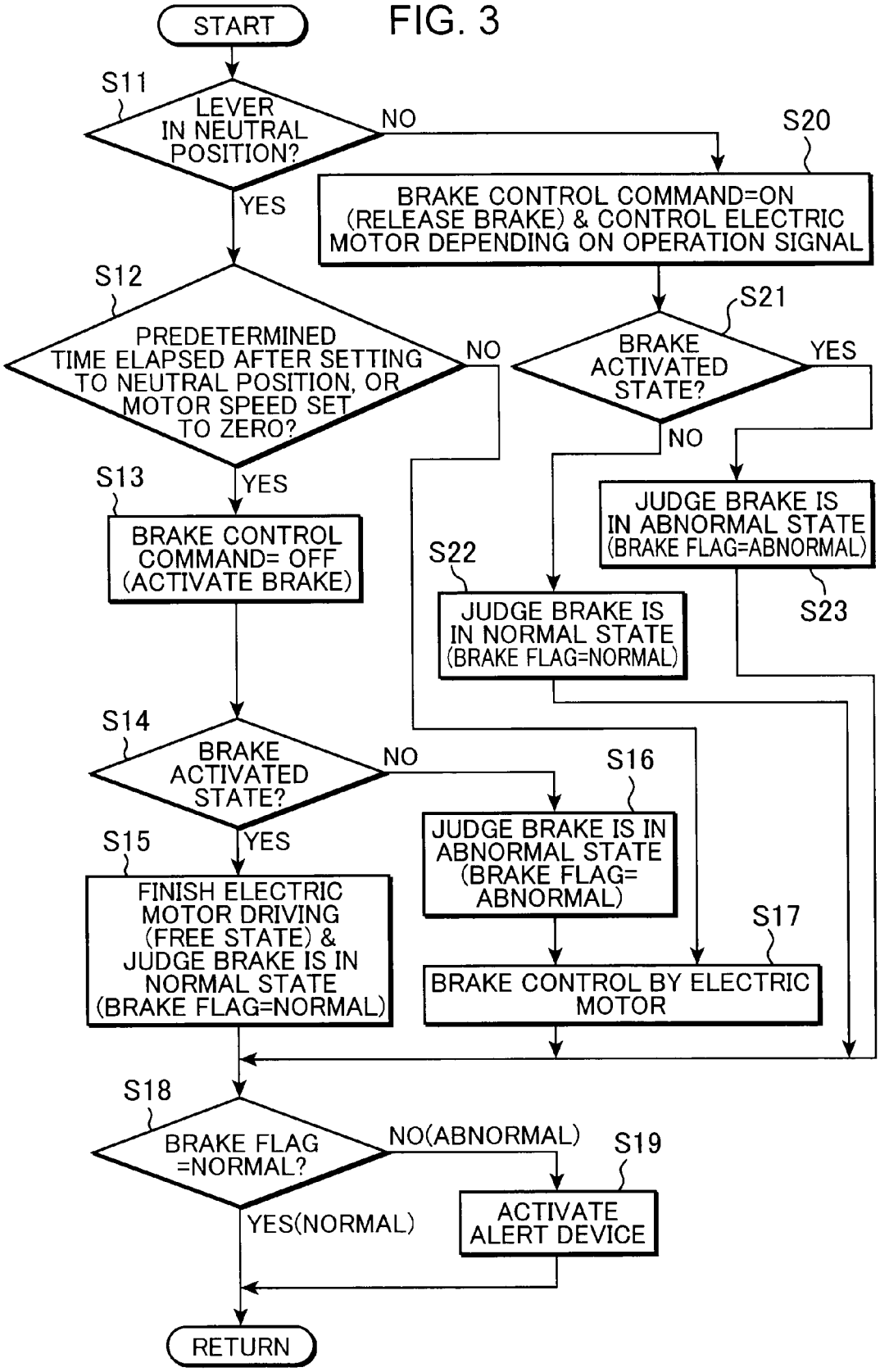
FIG. 3 is a flowchart showing a process to be executed by a slewing controller in another embodiment of the invention.
Figure 4:
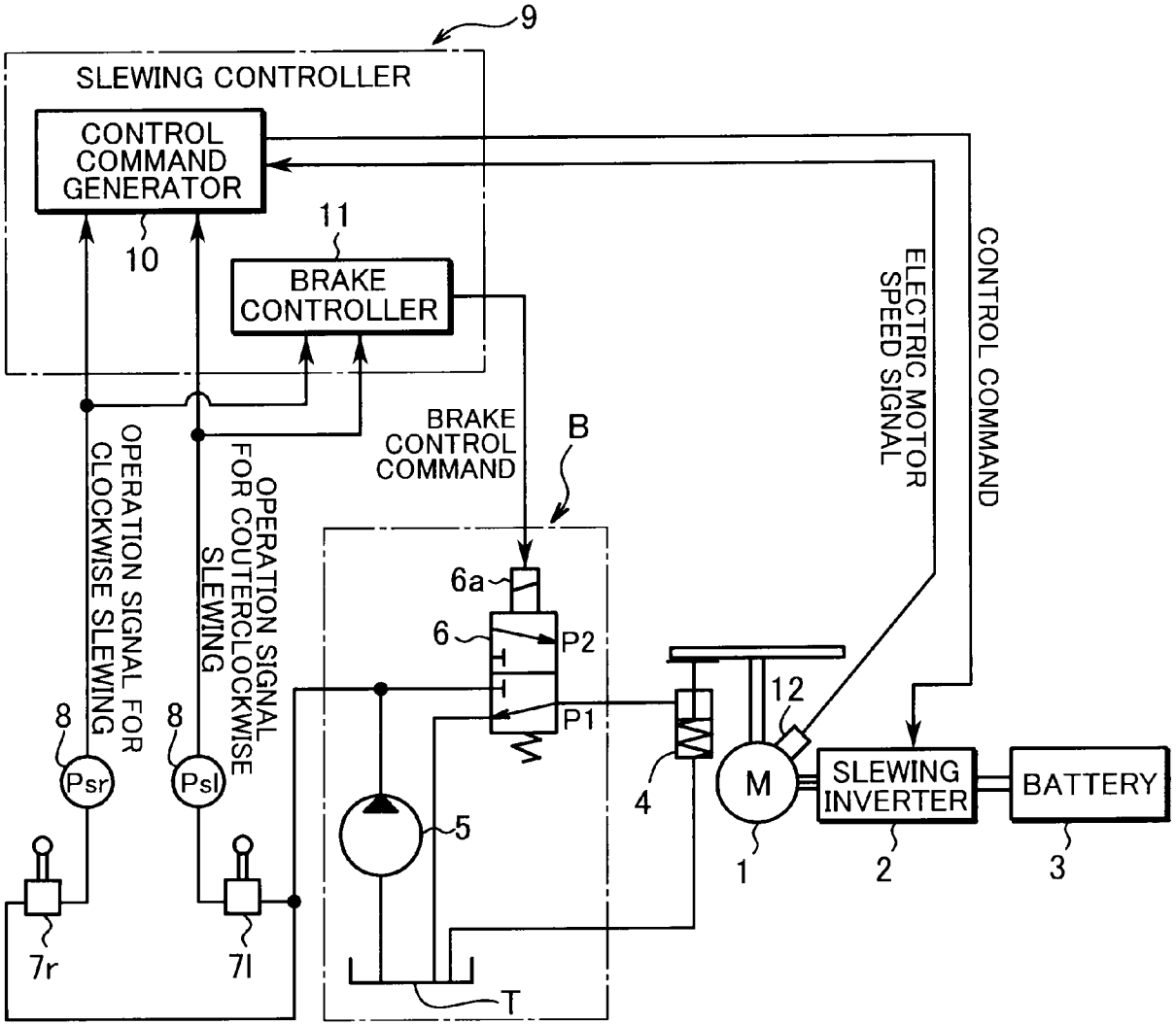
FIG. 4 is a block diagram showing an arrangement of a conventional slewing control device.

Embodiments of the invention are described referring to FIGS. 1 through 3.

A slewing control device shown in FIG. 1 is provided with an electric motor 1 for driving and slewing a slewing body, a slewing inverter 2 for controlling the electric motor 1, a battery 3 to be connected to the electric motor 1 via the slewing inverter 2, a hydraulic mechanical brake 4 for generating a mechanical braking force for the electric motor 1, a brake circuit B for driving the mechanical brake 4, a clockwise-slewing remote control valve (an operation member) 7*r* and a counterclockwise-slewing remote control valve (an operation member) 7*l* which are adapted to generate a secondary pressure depending on operation amounts of levers, pressure sensors 8, 8 for detecting the presence or absence of lever operation and operation amounts of the remote control valves 7*r*, 7*l*, respectively, an electric motor speed sensor 12 for detecting a speed of the electric motor 1, a slewing controller (a controller) 13 for controlling the electric motor 1 and the brake circuit B, a brake pressure sensor (a brake activation detecting member) 17 for detecting a pressure in a hydraulic passage for feeding or discharging hydraulic oil to or from the mechanical brake 4, and an alert device 18 for alerting an operator of occurrence of breakdown.

The electric motor 1 is driven by an electric power from the battery 3. In a hybrid machine, a power generator or a generator motor to be driven by an engine may also serve as a drive source for the electric motor 1.

The mechanical brake 4 is a negative brake which is operable to be switched to a brake activated state (the state shown in FIG. 1) by a spring force in response to release of a hydraulic pressure, and which is operable to be switched to a brake released state in response to application of a hydraulic pressure. The mechanical brake 4 is adapted to apply a braking force to the electric motor 1 so as to restrict slewing of the slewing body when the mechanical brake 4 is switched to the brake activated state. Specifically, the mechanical brake 4 has a brake pad 4*a* which is brought into pressing contact with a disc 1*a* connected to an output shaft of the electric motor 1. When the brake pad 4*a* is brought into pressing contact with the disc 1*a* of the electric motor 1 when the mechanical brake 4 is in the brake activated state, a braking force is applied to the electric motor 1.

The brake circuit B includes a hydraulic pump 5 (a hydraulic source) which is driven by an unillustrated engine, an electromagnetically switchable brake valve 6 which is operable to be switched between a discharge position P1 and a supply position P2, and a tank T. When the brake valve 6 is switched to the discharge position P1, hydraulic oil is discharged from the mechanical brake 4 to the tank T to thereby switch the mechanical brake 4 to a brake activated state. On the other hand, when the brake valve 6 is switched to the supply position P2, hydraulic oil is fed from the hydraulic pump 5 to the mechanical brake 4 to thereby switch the mechanical brake 4 to a brake released state. The brake valve 6 has a solenoid 6*a* for driving the brake valve 6.

The clockwise-slewing remote control valve 7*r* is operable to output a slewing command including information corresponding to the presence or absence of an operation by an operator, and information corresponding to a slewing direction and a slewing amount of the slewing body depending on the operation by the operator. Specifically, the clockwise-slewing remote control valve 7*r* is operable to output a secondary pressure corresponding to an operation amount of a lever 7*r*1 of the remote control valve 7*r* from a neutral position of the lever 7*r*1. The operation amount of the lever 7*r*1 corresponds to a slewing amount (a slewing angle) of the slewing body in clockwise direction.

The counterclockwise-slewing remote control valve 7*l* is operable to output a slewing command including information corresponding to the presence or absence of an operation by an operator, and information corresponding to a slewing direction and a slewing amount of the slewing body depending on the operation by the operator. Specifically, the counterclockwise-slewing remote control valve 7*l* is operable to output a secondary pressure corresponding to an operation amount of a lever 7*l*1 of the remote control valve 7*l* from a neutral position of the lever 7*l*1. The operation amount of the lever 7*l*1 corresponds to a slewing amount (a slewing angle) of the slewing body in counterclockwise direction.

The pressure sensor 8, 8 converts the presence or absence of an operation of the lever 7*r*1, 7*l*1 of the remote control valve 7*r*, 7*l* and an operation amount thereof into an electrical signal (a slewing operation signal), and outputs the electrical signal to the slewing controller 13. Specifically, the pressure sensor 8, 8 detects a secondary pressure outputted from the remote control valve 7*r*, 7*l*.

The electric motor speed sensor 12 detects a speed of the electric motor 1, converts the detected speed into an electrical signal, and outputs the electrical signal to the slewing controller 13.

The brake pressure sensor 17 detects an actual activated state of the mechanical brake 4, in other words, detects whether the mechanical brake 4 is in a brake activated state or in a brake released state. Specifically, the brake pressure sensor 17 detects a pressure on the output side of the brake valve 6, converts the detected pressure into an electrical signal (a brake activation detecting signal), and outputs the electrical signal to the slewing controller 13.

The slewing controller 13 outputs a control command for accelerating, decelerating, or stopping the electric motor 1, based on a slewing command (a slewing operation signal from the pressure sensor 8, 8) from the lever 7*r*1, 7*l*1. Specifically, the slewing controller 13 is provided with a control command generator 14, a brake controller 15, and a judging section 16.

The control command generator 14 outputs, to the slewing inverter 2, a control signal for accelerating, decelerating, or stopping the electric motor 1 depending on an operation amount of the lever 7*r*1, 7*l*1, and a stop holding command to be described later. Specifically, the control command generator 14 receives a slewing operation signal from the pressure sensor 8, 8, an electric motor speed signal from the electric motor speed sensor 12, and a signal indicative of a judging result from the judging section 16 to be described later.

The brake controller 15 outputs a brake control command corresponding to a release command or an activation command to the solenoid 6*a* of the brake valve 6 to thereby control a switching operation of the brake valve 6. Specifically, the brake controller 15 outputs a brake release command to the solenoid 6*a* when the lever 7*r*1, 7*l*1 is operated (when a slewing operation signal is inputted). On the other hand, the brake controller 15 outputs a brake activation command to the solenoid 6*a* when the lever 7*r*1, 7*l*1 is in a neutral position (when a slewing operation signal is not inputted, in other words, when the lever 7*r*1, 7*l*1 is not operated).

The judging section 16 judges whether the mechanical brake 4 is activated in a state corresponding to a brake control command, based on a brake control command to be outputted from the brake controller 15 to the brake valve 6, and a brake activation detecting signal to be inputted from the brake pressure sensor 17. Specifically, the judging section 16 judges whether the mechanical brake 4 is in an inconsistent state, in other words, in a state that the mechanical brake 4 is in a brake released state despite that an activation command is outputted from the brake controller 15. Further, the judging section 16 outputs a stop holding command to the slewing inverter 2 via the control command generator 14. Furthermore, the judging section 16 outputs, to the alert device 18 which is connected to the judging section 16, a command for activating the alert device 18 when breakdown has occurred.

The alert device 18 is activated in response to a command from the judging section 16.

In the following, a process to be executed by the slewing controller 13 shown in FIG. 1 is described in details, referring to the flowchart of FIG. 2.

When the process is started, it is judged whether the lever 7*r*1, 7*l*1 is in a neutral position (Step S1).

If it is judged that the lever is in the neutral position in Step S1 (YES in Step S1), it is judged whether a first condition (a brake control condition) that a predetermined time has elapsed after the lever 7*r*1, 7*l*1 is set to the neutral position, or a second condition (a brake control condition) that the speed of the electric motor 1 is set to zero, has been established (in Step S2). If it is judged that the first condition or the second condition has been established in Step S2 (YES in Step S2), an activation command is outputted to the brake valve 6 (the solenoid valve 6*a*) (in Step S3).

Then, it is judged whether the mechanical brake 4 is in a brake activated state, based on a brake activation detecting signal to be outputted from the brake pressure sensor 17 (in Step S4). In other words, it is judged whether an activated state (an operated state) of the mechanical brake 4 corresponding to a brake activation command is consistent with an actual activated state detected by the brake pressure sensor 17. If it is judged that both of the activated states are consistent with each other (YES in Step S4), control of the electric motor 1 is finished, and it is judged that the mechanical brake 4 is in a normal state (a brake flag is set to "normal") (in Step S5).

If, on the other hand, it is judged that the above two activated states are not consistent with each other, and that the mechanical brake 4 is in a released state (in other words, the mechanical brake 4 is in an inconsistent state) (NO in Step S4), it is judged that the mechanical brake 4 is in an abnormal state (a brake flag is set to "abnormal") (in Step S6). Then, a command for obtaining a torque for holding the slewing body in a stopped state is outputted to the slewing inverter 2 (the electric motor 1) (in Step S7).

After Step S5 or Step S7, it is judged whether the brake flag is set to "normal" or "abnormal" (in Step S8). In the case where it is judged that the brake flag is set to "abnormal" (a condition that the mechanical brake 4 is in a released state despite that an activation command is outputted to the mechanical brake 4; NO in Step S8), the alert device 18 is activated (in Step S9). On the other hand, if it is judged that the brake flag is set to "normal" (YES in Step S8), the process returns to Step S1.

In the case where it is judged that the lever 7*r*1, 7*l*1 is operated in Step S1 (NO in Step S1), the brake controller 15 outputs, to the brake valve 6, a command for switching the position of the brake valve 6 to the supply position P2 (see FIG. 1), and the control command generator 14 outputs a control command depending on a slewing operation signal to the electric motor 1 (the slewing inverter 2) (in Step S10). In other words, in Step S10, the mechanical brake 4 is switched to a brake released state, and the electric motor 1 is driven depending on an operation amount of the lever 7*r*1, 7*l*1.

Then, in Step S2, if it is judged that both of the first condition and the second condition have not been established (NO in Step S2), brake control by the electric motor 1 is continued (in Step S7). In other words, in Step S7, a command for obtaining a braking force for holding the slewing body in a stopped state is outputted to the electric motor 1 (slewing inverter 2).

In this embodiment, it is possible to judge whether the mechanical brake 4 is in an inconsistent state (e.g. an inconsistent state resulting from locking of a spool of the brake valve 6), in other words, a state that the mechanical brake 4 is in a brake released state despite that an activation command is outputted, based on a command (a release command or an activation command) to the brake circuit B, and a brake activated state (a pressure detected by the brake pressure sensor 17). Further, in this embodiment, it is possible to apply a braking torque for holding the slewing body in a stopped state to the electric motor 1, based on a judgment that an anomaly has occurred, if it is judged that the mechanical brake 4 is in an inconsistent state.

Thus, in this embodiment, it is possible to automatically detect breakdown (as to whether the mechanical brake 4 is in an inconsistent state) of the mechanical system of the mechanical brake 4, and to prevent an unexpected condition such as free slewing of the slewing body by the weight thereof on an inclined ground, whereby safe use of the working machine is secured.

Further, in this embodiment, a command for obtaining a braking torque for holding the slewing body in a stopped state is not outputted, in the case where the mechanical brake 4 is in an activated state despite that a release command is outputted to the mechanical brake 4. With this arrangement, it is possible to prevent an unintended driving of the electric motor in a condition that there is no likelihood that the slewing body may be moved despite that a certain breakdown has occurred. This enables to avoid drawbacks such as energy loss of the electric motor, or overheat of the electric motor resulting from torque generation for a long time.

Furthermore, in this embodiment, the alert device 18 is activated, only if it is judged that the mechanical brake 4 is in an inconsistent state, in other words, only if there is a problem concerning safe use of the working machine, and breakdown particularly in need of prompt repair has occurred. This enables to securely alert the operator of occurrence of a serious breakdown, and prompt the operator to expedite the repair.

The slewing control device of this embodiment is provided with the mechanical brake 4 including a hydraulic negative brake, and the brake pressure sensor 17. With this arrangement, it is possible to judge whether the mechanical brake 4 is in a brake released state or in a brake activated state, based on a pressure detected by the brake pressure sensor 17.

Furthermore, the slewing control device of this embodiment is provided with the electromagnetic switchable brake valve 6. With this arrangement, it is possible to judge whether the mechanical brake 4 is in an inconsistent state, based on an electrical signal to be outputted from the brake pressure sensor 17, and an electrical signal to be outputted to the brake valve 6.

In this embodiment, in the case where an activation command is outputted from the brake controller 15 (in Step S3), and if it is judged that the mechanical brake 4 is in an inconsistent state (NO in Step S4), a command for obtaining a braking torque for holding the slewing body in a stopped state is outputted to the electric motor 1. Further, in this embodiment, in the case where a slewing command has not been outputted (YES in Step S1), and a brake control condition (the first condition or the second condition) has not been established (NO in Step S2), a command for obtaining a braking torque for holding the slewing body in a stopped state is outputted to the electric motor 1, without depending on a judgment as to whether the mechanical brake 4 is in an inconsistent state (in Step S7). Accordingly, in the case where a slewing command has not been outputted and the brake control condition has been established, it is possible to securely apply a braking force by the mechanical brake 4 or a braking force resulting from a braking torque of the electric motor 1 to the slewing body. On the other hand, in the case where the brake control condition has not been established, it is possible to apply a braking force resulting from a braking torque of the electric motor 1 to the slewing body, while simplifying the process by the slewing controller 13 by omitting a judgment as to whether the mechanical brake 4 is in an inconsistent state.

In this embodiment, the alert device 18 is activated, only if the mechanical brake 4 is in a released state despite that an activation command is outputted to the mechanical brake 4, in other words, only if a torque for holding the slewing body in a stopped state should be generated in the electric motor 1, and prompt repair is required. However, the embodiment of the invention is not limited to the above arrangement, wherein the alert device 18 is activated only if the mechanical brake 4 is in an inconsistent state. Specifically, as another embodiment, it is possible to activate the alert device 18 even if the mechanical brake 4 is in an activated state despite that a brake release command is outputted to the mechanical brake 4. This is because the above condition corresponds to a state that slewing of the slewing body is disabled, and the electric motor 1 may be overheated although a hazardous degree is low.

The another embodiment is described referring to FIG. 3.

Since Steps 11 through S20 in FIG. 3 are identical to Steps S1 through S10 in FIG. 2, description of Steps 11 through S20 is omitted. Hereinafter, only the differences in steps between FIG. 2 and FIG. 3 are described.

In Step S20, a command for switching the position of the brake valve 6 to the supply position P2 is outputted to the brake valve 6, and a control command depending on a slewing operation signal is outputted to the slewing inverter 2. After Step S20, similarly to Step S14, it is judged whether the mechanical brake 4 is in an activated state (in Step S21). Specifically, in Step S21, it is judged whether an activated state corresponding to a brake activation detecting signal from the brake pressure sensor 17 is consistent with an activated state of the mechanical brake 4 corresponding to a brake activation command.

If it is judged that the mechanical brake 4 is not in an activated state (NO in Step S21), the operation of the mechanical brake 4 is "normal". Accordingly, in this case, it is judged that the mechanical brake 4 is in a normal state (a brake flag is set to "normal") (in Step S22), and then, the process proceeds to Step S18.

If, on the other hand, in Step S21, it is judged that the mechanical brake 4 is in an activated state (YES in Step S21), the operation of the mechanical brake 4 is "abnormal". In other words, in this case, the mechanical brake 4 is in an activated state despite that a release command is outputted to the mechanical brake 4. Accordingly, in this case, it is judged that the mechanical brake 4 is in an abnormal state (a brake flag is set to "abnormal") (in Step S23), and then, the process proceeds to Step S18.

Then, in Step S18, it is judged whether the brake flag is set to "normal" or "abnormal". If it is judged that the brake flag is set to "normal" (YES in Step S18), the process returns to Step S11. If, on the other hand, it is judged that the brake flag is set to "abnormal" (NO in Step S18), the alert device 18 is activated, and then, the process returns to Step S11.

In the above embodiments, the operator is alerted of an anomaly of the mechanical brake 4, and is prompted to remove the breakdown condition.

In the above embodiments, the brake pressure sensor 17 for detecting a pressure in a pipeline connecting the brake valve 6 and the mechanical brake 4 is used as a brake activation detecting member for detecting an actual activated state of the mechanical brake 4. Alternatively, the brake activation detecting member is not limited to the brake pressure sensor 17. For instance, it is possible to use a displacement sensor for directly detecting a movement (e.g. a stroke of a shaft for driving the brake pad 4*a*) of the mechanical brake 4, as the brake activation detecting member.

In the above embodiments, an electromagnetically switchable brake valve is used as the brake valve 6. Alternatively, a hydraulic pilot switching valve may be used as the brake valve 6. In the modification, since an anomaly resulting from e.g. an operation failure of a spool or clogging in a hydraulic passage may occur, substantially the same effects as the embodiments can be obtained.

The foregoing embodiments mainly include the invention having the following arrangements.

An aspect of the invention is to provide a slewing control device for a working machine having a slewing body. The slewing control device includes an electric motor which slews the slewing body; an operation member which is operable to output a slewing command including information corresponding to presence or absence of an operation by an operator, and information corresponding to a slewing direction and a slewing amount of the slewing body in response to the operation by the operator; a mechanical brake which is operable to be switched between a brake activated state in which the slewing body is held so that slewing of the slewing body is restricted, and a brake released state in which holding of the slewing body is released; a brake circuit which is adapted to switch the mechanical brake between the brake activated state and the brake released state; a brake activation detecting member which detects whether the mechanical brake is in the brake activated state or in the brake released state; and a controller which controls the electric motor and the brake circuit. In the above arrangement, the controller is operable to output a control command for accelerating, decelerating, or stopping the electric motor, based on the slewing command from the operation member; and is operable to output, to the brake circuit, a release command for switching the mechanical brake to the brake released state when the operation member is operated, and output, to the brake circuit, an activation command for switching the mechanical brake to the brake activated state when the operation member is not operated. The controller judges whether the mechanical brake is in an inconsistent state that is a state that the mechanical brake is in the brake released state when the activation command is outputted, based on a command to be outputted to the brake circuit and the brake activated state detected by the brake activation detecting member, and outputs, to the electric motor, a command for obtaining a braking torque for holding the slewing body in a stopped state, if it is judged that the mechanical brake is in the inconsistent state.

With the above arrangement, it is possible to judge whether the mechanical brake is in an inconsistent state (e.g. a state that the mechanical brake is brought to a switching disabled state from a brake released state), namely, a state that the mechanical brake is in a brake released state despite that a brake activation command is outputted, based on a command (a release command or an activation command) to be outputted to the brake circuit, and an actual brake activated state (an activated state detected by the brake activation detecting member). Further, with the above arrangement, it is possible to output, to the electric motor, a command for obtaining a braking torque for holding the slewing body in a stopped state, based on a judgment that an anomaly has occurred in the case where the mechanical brake is in an inconsistent state. Accordingly, the above arrangement enables to automatically detect breakdown (whether the mechanical brake is in an inconsistent state) of a mechanical system of the mechanical brake, and to prevent an unexpected condition such as free slewing of the slewing body by the weight thereof on an inclined ground, whereby safe use of the working machine is secured.

Further, contrary to the above, it is preferable not to output a command for obtaining a braking torque for holding the slewing body in a stopped state, in the case where the mechanical brake is in a brake activated state despite that a release command is outputted to the mechanical brake. With this arrangement, it is possible to prevent an unintended driving of the electric motor in a condition that there is no likelihood that the slewing body may be moved despite that a certain breakdown has occurred. This enables to avoid drawbacks such as energy loss of the electric motor, or overheat of the electric motor resulting from torque generation for a long time.

Preferably, the slewing control device may further include an alert device, wherein the controller activates the alert device, in the case where the command to be outputted to the brake circuit is inconsistent with the brake activated state detected by the brake activation detecting member.

As described, since the slewing control device is provided with the controller for controlling the alert device, it is possible to activate the alert device in both of the case that the mechanical brake is not operated despite that the activation command is outputted, and the case that the mechanical brake is activated despite that the release command is outputted. This enables to alert the operator of occurrence of breakdown, and prompts the operator to repair for removal of the breakdown condition.

Preferably, the slewing control device may further include an alert device, wherein the controller activates the alert device only if it is judged that the mechanical brake is in the inconsistent state.

As described above, since the slewing control device is provided with the controller for controlling the alert device, it is possible to activate the alert device only if the mechanical brake is not activated despite that the activation command is outputted, in other words, only if there is a problem concerning safe use of the working machine, and breakdown particularly in need of prompt repair has occurred. This enables to securely alert the operator of occurrence of a serious breakdown, and prompt the operator to expedite the repair.

Preferably, in the slewing control device, the controller may include a control command generator which generates the control command based on the slewing command, a brake controller which outputs the release command or the activation command to the brake circuit, based on the presence or absence of the operation of the operation member, and a judging section which judges whether the mechanical brake is in the inconsistent state, based on a command to be outputted from the brake controller and a detection result by the brake activation detecting member; and the control command generator may output, to the electric motor, the command for obtaining the braking torque for holding the slewing body in the stopped state, if the judging section judges that the mechanical brake is in the inconsistent state.

More preferably, in the slewing control device, the mechanical brake may be a hydraulic negative brake which is configured to be switched to the brake released state upon application of a hydraulic pressure, and which is configured to be switched to the brake activated state upon release from the hydraulic pressure; and the brake activation detecting member may include a pressure sensor which detects a pressure in a hydraulic passage to be connected to the mechanical brake, and which outputs the detected pressure as an electrical signal to the judging section.

As described above, since the slewing control device is provided with the hydraulic negative brake and the pressure sensor, it is possible to judge whether the mechanical brake is in a brake released state or in a brake activated state, based on a pressure to be detected by the pressure sensor.

Preferably, in the slewing control device, the brake circuit may be provided with an electromagnetically switchable brake valve which is disposed between the mechanical brake, and a hydraulic source and a tank, and which is operable to be switched between a supply position at which hydraulic oil is suppliable from the hydraulic source to the mechanical brake, and a discharge position at which the hydraulic oil is discharged from the mechanical brake to the tank; the brake controller may output, to the brake valve, an electrical signal for switching the brake valve to the supply position or the discharge position; and the judging section may judge whether the mechanical brake is in the inconsistent state, based on the electrical signal to be outputted from the brake controller, and the electrical signal to be outputted from the brake activation detecting member.

As described above, since the slewing control device is provided with the electromagnetic switchable brake valve, it is possible to judge whether the mechanical brake is in an inconsistent state, based on the electrical signal to be outputted from the pressure sensor, and the electrical signal to be outputted to the brake valve.

Preferably, in the slewing control device, the brake controller may output the activation command, in the case where the operation member is not operated and a predetermined brake control condition has been established, and the control command generator may output, to the electric motor, the command for obtaining the braking torque for holding the slewing body in the stopped state, in the case where it is judged that the mechanical brake is in the inconsistent state when the activation command is outputted; and outputs, to the electric motor, the command for obtaining the braking torque for holding the slewing body in the stopped state, without depending on whether the mechanical brake is in the inconsistent state, in the case where it is judged that the operation member is not operated and the brake control condition has not been established.

As described above, since the command for obtaining the braking torque for holding the slewing body in the stopped state is controlled, the following advantage is obtained. Specifically, in the case where the operation member is not operated and the brake control condition has been established, it is possible to securely apply a braking force by the mechanical brake or a braking force resulting from a braking torque of the electric motor to the slewing body. On the other hand, in the case where the brake control condition has not been established, it is possible to apply a braking force resulting from a braking torque of the electric motor to the slewing body, while simplifying the process by the controller by omitting a judgment as to whether the mechanical brake is in an inconsistent state.

This application is based on Japanese Patent Application No. 2010-060172 filed on Mar. 17, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A slewing control device for a working machine having a slewing body, comprising:

an electric motor which slews the slewing body;

an operation member which is operable to output a slewing command including information corresponding to presence or absence of an operation by an operator, and information corresponding to a slewing direction and a slewing amount of the slewing body in response to the operation by the operator;

a mechanical brake which is operable to be switched between a brake activated state in which the slewing body is held so that slewing of the slewing body is restricted, and a brake released state in which holding of the slewing body is released;

a brake circuit which is adapted to switch the mechanical brake between the brake activated state and the brake released state;

a brake activation detecting member which detects whether the mechanical brake is in the brake activated state or in the brake released state; and a controller which controls the electric motor and the brake circuit, wherein the controller is operable to output a control command for accelerating, decelerating, or stopping the electric motor, based on the slewing command from the operation member; and is operable to output, to the brake circuit, a release command for switching the mechanical brake to the brake released state when the operation member is operated, and output, to the brake circuit, an activation command for switching the mechanical brake to the brake activated state when the operation member is not operated, and the controller judges whether the mechanical brake is in an inconsistent state that is a state that the mechanical brake is in the brake released state when the activation command is outputted, based on a command to be outputted to the brake circuit and the brake activated state detected by the brake activation detecting member, and outputs, to the electric motor, a command for obtaining a braking torque for holding the slewing body in a stopped state, if it is judged that the mechanical brake is in the inconsistent state.

2. The slewing control device according to claim 1, further comprising:

an alert device, wherein the controller activates the alert device, in the case where the command to be outputted to the brake circuit is inconsistent with the brake activated state detected by the brake activation detecting member.

3. The slewing control device according to claim 1, further comprising:

an alert device, wherein the controller activates the alert device only if it is judged that the mechanical brake is in the inconsistent state.

4. The slewing control device according to claim 1, wherein the controller includes a control command generator which generates the control command based on the slewing command, a brake controller which outputs the release command or the activation command to the brake circuit, based on the presence or absence of the operation of the operation member, and a judging section which judges whether the mechanical brake is in the inconsistent state, based on a command to be outputted from the brake controller and a detection result by the brake activation detecting member, and the control command generator outputs, to the electric motor, the command for obtaining the braking torque for holding the slewing body in the stopped state, if the judging section judges that the mechanical brake is in the inconsistent state.

5. The slewing control device according to claim 4, wherein the mechanical brake is a hydraulic negative brake which is configured to be switched to the brake released state upon application of a hydraulic pressure, and is configured to be switched to the brake activated state upon release from the hydraulic pressure, and the brake activation detecting member includes a pressure sensor which detects a pressure in a hydraulic passage to be connected to the mechanical brake, and which outputs the detected pressure as an electrical signal to the judging section.

6. The slewing control device according to claim 5, wherein the brake circuit is provided with an electromagnetically switchable brake valve which is disposed between the mechanical brake, and a hydraulic source and a tank, and which is operable to be switched between a supply position at which hydraulic oil is suppliable from the hydraulic source to the mechanical brake, and a discharge position at which the hydraulic oil is discharged from the mechanical brake to the tank, the brake controller outputs, to the brake valve, an electrical signal for switching the brake valve to the supply position or the discharge position, and the judging section judges whether the mechanical brake is in the inconsistent state, based on the electrical signal to be outputted from the brake controller, and the electrical signal to be outputted from the brake activation detecting member.

7. The slewing control device according to claim 4, wherein the brake controller outputs the activation command, in the case where the operation member is not operated and a predetermined brake control condition has been established, and the control command generator outputs, to the electric motor, the command for obtaining the braking torque for holding the slewing body in the stopped state, in the case where it is judged that the mechanical brake is in the inconsistent state when the activation command is outputted; and outputs, to the electric motor, the command for obtaining the braking torque for holding the slewing body in the stopped state, without depending on whether the mechanical brake is in the inconsistent state, in the case where it is judged that the operation member is not operated and the brake control condition has not been established.

8. A working machine comprising:

the slewing control device of claim 1; and a slewing body which is slewed by the electric motor of the slewing control device.

* * * * *

UNITED STATES PATENT AND TRADEMARK OFFICE

CERTIFICATE OF CORRECTION

PATENT NO. : 8,405,328 B2
APPLICATION NO. : 13/036391
DATED : March 26, 2013
INVENTOR(S) : Masayuki Komiyama et al.

It is certified that error appears in the above-identified patent and that said Letters Patent is hereby corrected as shown below:

On the title page, Item (75), the 4th Inventor's Last Name is incorrect. Item (75) should read:

--(75) Inventors: Masayuki Komiyama, Hiroshima (JP);
Natsuki Yumoto, Hiroshima (JP);
Yoshiyasu Umezu, Hiroshima (JP);
Masayuki Kagoshima, Hiroshima (JP);--

Signed and Sealed this
Twenty-eighth Day of May, 2013

Teresa Stanek Rea
*Acting Director of the United States Patent and Trademark Office*